US008948634B2

(12) United States Patent
Kamei

(10) Patent No.: US 8,948,634 B2
(45) Date of Patent: Feb. 3, 2015

(54) IMAGE FORMING APPARATUS

(71) Applicant: Canon Kabushiki Kaisha, Tokyo (JP)

(72) Inventor: Yasuo Kamei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/038,638

(22) Filed: Sep. 26, 2013

(65) Prior Publication Data

US 2014/0093262 A1 Apr. 3, 2014

(30) Foreign Application Priority Data

Sep. 28, 2012 (JP) ..... 2012-215698

(51) Int. Cl.
*G03G 15/00* (2006.01)

(52) U.S. Cl.
CPC ..... *G03G 15/5025* (2013.01); *G03G 15/5058* (2013.01); *G03G 2215/0129* (2013.01); *G03G 2215/0164* (2013.01)
USPC ..... 399/49; 399/72

(58) Field of Classification Search
USPC ..... 399/9, 15, 38, 42, 46, 49, 72, 74; 358/1.9, 518
See application file for complete search history.

(56) References Cited

U.S. PATENT DOCUMENTS 7,476,847 B2 * 1/2009 Kaihotsu ..... 250/235
8,594,517 B2 * 11/2013 Usui et al. ..... 399/15

FOREIGN PATENT DOCUMENTS

JP 2004-086013 A 3/2004

* cited by examiner

*Primary Examiner* — Hoan Tran
(74) *Attorney, Agent, or Firm* — Canon USA Inc. IP Division

(57) ABSTRACT

An image forming apparatus includes a measurement unit configured to emit light to a measurement target, and measure reflected light from the measurement target; a white reference plate disposed at a position opposed to the measurement unit; an image forming unit configured to form a measurement image on a sheet; and a calculation unit configured to, based on a measurement value of the white reference plate and a measurement value of the measurement image by the measurement unit, calculate a spectral reflectivity of reflected light from the measurement image. The calculation unit is configured to, after correcting a variation due to color change of the white reference plate with respect to the measurement value of the white reference plate, calculate the spectral reflectivity.

20 Claims, 12 Drawing Sheets

FIG.8

| WAVELENGTH | AMOUNT OF REFLECTED LIGHT | | | LINEAR/NON-LINEAR VARIATION |
|---|---|---|---|---|
| | INITIAL STAGE | 8 HOURS | 16 HOURS | |
| 400 | 642 | 637 | 636 | NON-LINEAR |
| 410 | 1904 | 1899 | 1898 | NON-LINEAR |
| 420 | 1974 | 1976 | 1976 | NON-LINEAR |
| 430 | 1512 | 1513 | 1512 | NON-LINEAR |
| 440 | 1665 | 1662 | 1661 | NON-LINEAR |
| 450 | 2186 | 2182 | 2181 | NON-LINEAR |
| 460 | 2665 | 2662 | 2662 | NON-LINEAR |
| 470 | 2842 | 2841 | 2840 | LINEAR |
| 480 | 2749 | 2749 | 2748 | NON-LINEAR |
| 490 | 2562 | 2561 | 2560 | LINEAR |
| 500 | 2419 | 2416 | 2413 | LINEAR |
| 510 | 2366 | 2362 | 2358 | LINEAR |
| 520 | 2401 | 2395 | 2389 | LINEAR |
| 530 | 2467 | 2461 | 2455 | LINEAR |
| 540 | 2528 | 2522 | 2516 | LINEAR |
| 550 | 2561 | 2556 | 2551 | LINEAR |
| 560 | 2571 | 2567 | 2563 | LINEAR |
| 570 | 2556 | 2553 | 2550 | LINEAR |
| 580 | 2605 | 2602 | 2599 | LINEAR |
| 590 | 2688 | 2686 | 2684 | LINEAR |
| 600 | 2814 | 2812 | 2810 | LINEAR |
| 610 | 2985 | 2983 | 2982 | NON-LINEAR |
| 620 | 3095 | 3094 | 3093 | LINEAR |
| 630 | 3078 | 3078 | 3078 | NON-LINEAR |
| 640 | 2971 | 2971 | 2971 | NON-LINEAR |
| 650 | 2777 | 2778 | 2778 | NON-LINEAR |
| 660 | 2459 | 2461 | 2461 | NON-LINEAR |
| 670 | 2106 | 2107 | 2107 | NON-LINEAR |
| 680 | 1787 | 1788 | 1788 | NON-LINEAR |
| 690 | 1492 | 1493 | 1493 | NON-LINEAR |
| 700 | 1175 | 1176 | 1176 | NON-LINEAR |

WAVELENGTH = λ1

WAVELENGTH = λ2

FIG.10

| | TIME | | | | | | |
|---|---|---|---|---|---|---|---|
| WAVELENGTH | $t_1$ | $t_2$ | $t_3$ | $\cdots$ | $t_{x-2}$ | $t_{x-1}$ | $t_x$ |
| $\lambda_1$ | $Lt_1(\lambda_1)$ | $Lt_2(\lambda_1)$ | $Lt_3(\lambda_1)$ | | | | |
| $\lambda_2$ | $Lt_1(\lambda_2)$ | $Lt_2(\lambda_2)$ | | | | | |
| $\lambda_3$ | $Lt_1(\lambda_3)$ | | | | | | |
| $\vdots$ | | | | | | | |
| $\lambda_{y-2}$ | | | | | | | $Lt_x(\lambda_{y-2})$ |
| $\lambda_{y-1}$ | | | | | | $Lt_{x-1}(\lambda_{y-1})$ | $Lt_x(\lambda_{y-1})$ |
| $\lambda_y$ | | | | | $Lt_{x-2}(\lambda_y)$ | $Lt_{x-1}(\lambda_y)$ | $Lt_x(\lambda_y)$ |

IMAGE FORMING APPARATUS

BACKGROUND OF THE INVENTION

1. Field of the Invention

The present disclosure generally relates to image forming and, more particularly, to an image forming apparatus including a function for measuring the color of a measurement image.

2. Description of the Related Art

Factors of quality of images (hereinafter, referred to as image quality) of an image forming apparatus generally include graininess, in-plane uniformity, character quality, and color reproducibility (including color stability). Nowadays, multicolor image forming apparatuses are prevalent, and in the usage environment, color reproducibility is regarded as one of the most important factors of the image quality.

A person has memories of expected colors (especially, human skin, blue sky, metal, etc.) derived from experiences and may feel uncomfortable if the colors are beyond an allowable range thereof. Such colors are called memory colors, and the reproducibility of the colors becomes an important factor in outputting photographic images, and the like.

In addition to the photographic images, also in document images, the degree of demand for color reproducibility (including stability) to the image forming apparatuses is growing among office users who feel uncomfortable with differences from colors on monitors, and users of graphic arts who pursue color reproducibility in computer graphics (CG) images.

In order to fulfill such users' demands for color reproducibility, an image forming apparatus for reading a measurement image (patch image) formed on a sheet with a measurement unit (color sensor) provided on a conveyance path of the sheet is discussed (for example, see Japanese Patent Application Laid-Open No. 2004-086013). In the image forming apparatus, based on a read result of a patch image by the color sensor, feedback on process conditions such as an amount of exposure and developing bias is provided, thereby enabling reproducibility at a certain density, a certain gradation, and a certain tint.

In the color sensor described in Japanese Patent Application Laid-Open No. 2004-086013, however, the color detection accuracy decreases due to factors such as output variations of a light source caused by change in ambient temperature. To solve the problem, a white reference plate may be arranged at a position opposed to the color sensor, and calibration for measuring the white reference plate with the color sensor and correcting the detected value of the color sensor may be performed.

Specifically, a spectral reflectivity $R(\lambda)$ of the patch image can be calculated by the following (equation 1).

$$R(\lambda)=P(\lambda)/W(\lambda) \quad \text{(equation 1).}$$

Where reflected light from the white reference plate is $W(\lambda)$, and reflected light from a patch image is $P(\lambda)$.

In the calculation of the spectral reflectivity of the patch image using the white reference plate, an error in the measurement value may occur due to color change of the white reference plate caused by the emitted light. If materials contained in the white reference plate include a material that changes color by oxidation by light, color change occurs due to light emission to the white reference plate.

During the calibration operation, light is emitted to the white reference plate, and as the number of times of the calibration increases, the color change gradually proceeds due to the emitted light, thereby increasing errors in measurement values.

SUMMARY OF THE INVENTION

The present disclosure is directed to an image forming apparatus capable of maintaining measurement accuracy of a measurement image even if a white reference plate changes color due to emitted light.

According to an aspect of the present disclosure, an image forming apparatus including a measurement unit configured to emit light to a measurement target, and measure reflected light from the measurement target; a white reference plate disposed at a position opposed to the measurement unit; an image forming unit configured to form a measurement image on a sheet; and a calculation unit configured to, based on a measurement value of the white reference plate and a measurement value of the measurement image by the measurement unit, calculate a spectral reflectivity of reflected light from the measurement image is provided. The calculation unit is configured to, after correcting a variation due to color change of the white reference plate with respect to the measurement value of the white reference plate, calculate the spectral reflectivity.

Further features and aspects of the present disclosure will become apparent from the following description of exemplary embodiments with reference to the attached drawings.

BRIEF DESCRIPTION OF THE DRAWINGS

FIG. 8 illustrates an example of linear/non-linear variations of the reflected light in each wavelength range.

FIG. 10 illustrates a correction table.

DESCRIPTION OF THE EMBODIMENTS

Image Forming Apparatus

In this exemplary embodiment, solutions for the above-described problems are described using an electrophotographic laser beam printer. As an example, for an image formation method, an electrophotographic method is employed. Note that the exemplary embodiment of the present disclosure can be applied to an inkjet method or a sublimation method. In the inkjet method, an image forming unit for discharging ink onto a sheet to form an image and a fixing unit (drying unit) for drying the ink are used.

Figure 1:
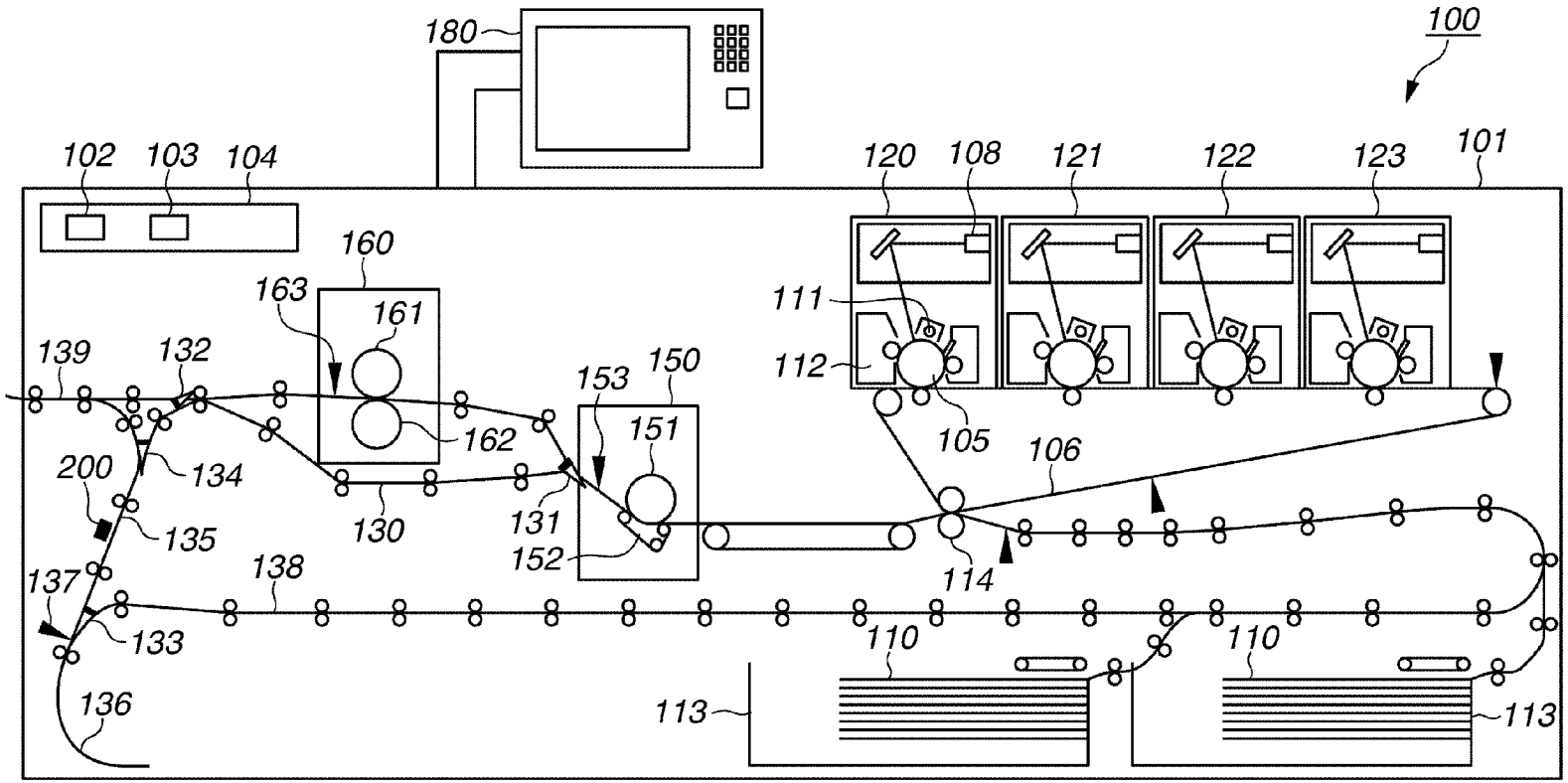
FIG. 1 is a cross-sectional view illustrating a configuration of an image forming apparatus 100.

FIG. 1 is a cross-sectional view illustrating a configuration of the image forming apparatus 100. The image forming apparatus 100 includes a casing 101. The casing 101 includes mechanisms constituting an engine unit, and a control board storage unit 104. The control board storage unit 104 stores an engine control unit 102 for performing control relating to each print process processing (for example, paper feed processing) by the mechanisms, and a printer controller 103. As used herein, the term "unit" generally refers to any combination of software, firmware, hardware, or any other component that is used to effectuate a purpose.

As illustrated in FIG. 1, the engine unit includes four stations 120, 121, 122, and 123 respectively corresponding to YMCK. The stations 120, 121, 122, and 123 serve as image forming units for transferring a toner onto a sheet 110 to form an image. YMCK is an abbreviation of yellow, magenta, cyan, and black. Each station has substantially common components. A photosensitive drum 105 is one kind of image bearing member, and is charged at a uniform surface potential by a primary charger 111. On the photosensitive drum 105, a latent image is formed by a laser beam emitted from a laser 108. A development unit 112 develops the latent image with a color material (toner) to form a toner image. The toner image (visible image) is transferred onto an intermediate transfer member 106. The visible image formed on the intermediate transfer member 106 is transferred onto a sheet 110 conveyed from a container 113 with transfer rollers 114.

The fixing processing mechanism according to the exemplary embodiment includes a first fixing unit 150 and a second fixing unit 160 for heating and pressing the toner image transferred on the sheet 110 to fix it onto the sheet 110. The first fixing unit 150 includes a fixing roller 151 for applying heat onto the sheet 110, a pressure belt 152 for bringing the sheet 110 into press contact with the fixing roller 151, and a first fixing sensor 153 for detecting completion of the fixing operation. The fixing roller 151 is a hollow roller, and includes a heater inside the roller.

The second fixing unit 160 is arranged on the downstream side of the first fixing unit 150 in the conveyance direction of the sheet 110. The second fixing unit 160 applies glossiness to the toner image fixed on the sheet 110 by the first fixing unit 150, and ensures fixability. The second fixing unit 160 includes, similarly to the first fixing unit 150, a fixing roller 161, a pressure roller 162, and a second fixing sensor 163. Depending on the types of the sheet 110, it is not necessary to cause the sheet 110 to pass through the second fixing unit 160. In such a case, to reduce energy consumption, the sheet 110 passes through a conveyance path 130 without passing through the second fixing unit 160.

For example, in a case where a setting for applying a lot of glossiness onto the sheet 110 has been set, or in a case where the sheet 110 is thick paper that involves a lot of heat for fixing, the sheet 110 that has passed through the first fixing unit 150 is also conveyed to the second fixing unit 160. Meanwhile, in a case where the sheet 110 is plain paper or thin paper, and a setting for applying a lot of glossiness has not been set, the sheet 110 is conveyed to the conveyance path 130 for detouring the second fixing unit 160. A switching member 131 performs control whether to convey the sheet 110 to the second fixing unit 160 or to detour the second fixing unit 160 to convey the sheet 110.

A switching member 132 is a guiding member for guiding the sheet 110 to a conveyance path 135 or to an external discharging path 139. The leading edge of the sheet 110 guided to the conveyance path 135 passes through a reverse sensor 137, and the sheet 110 is conveyed to a reversing unit 136. In response to detection of the trailing edge of the sheet 110 by the reverse sensor 137, the conveyance direction of the sheet 110 is switched. A switching member 133 is a guiding member for guiding the sheet 110 to a conveyance path 138 for two-sided image formation or to the conveyance path 135.

Figure 3:
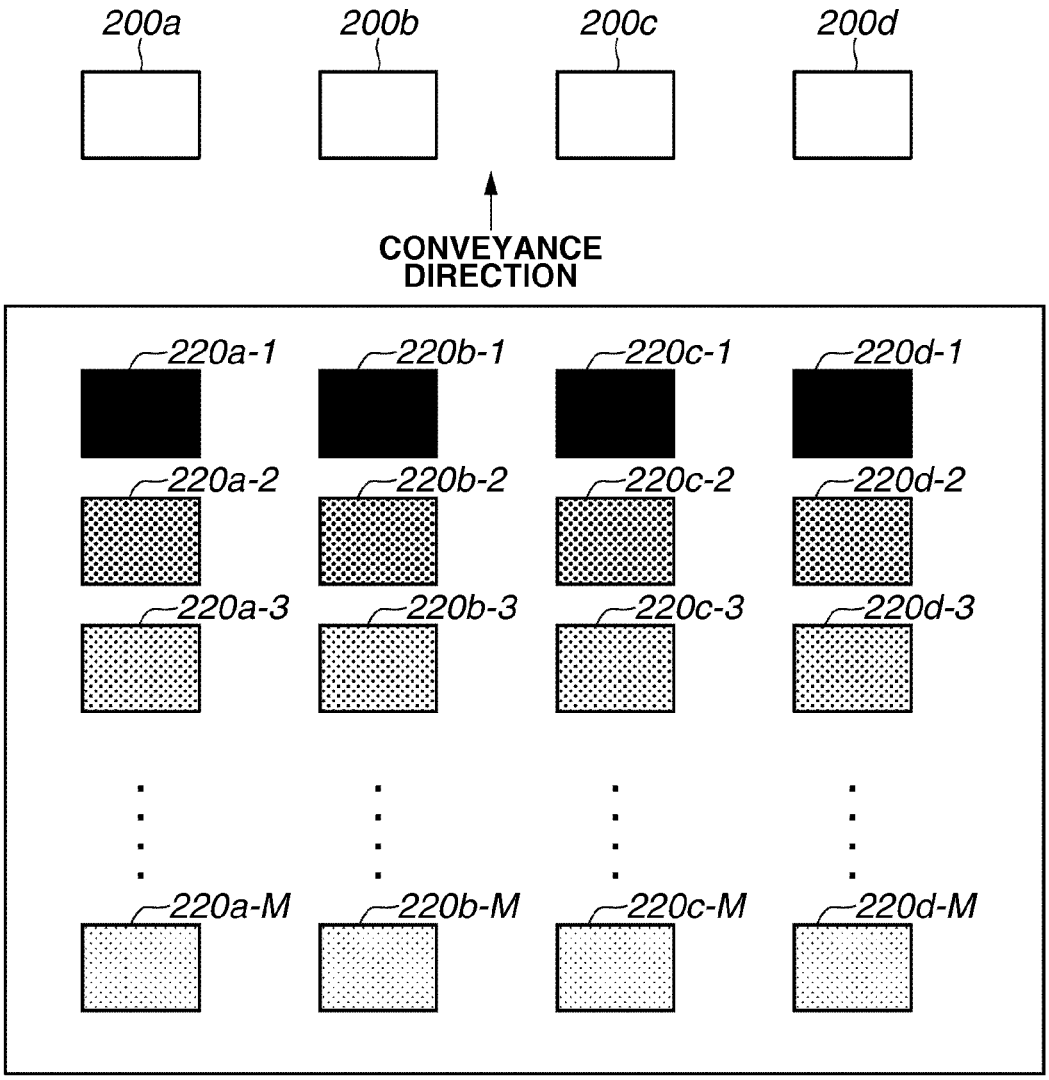
FIG. 3 illustrates an image of color measurement chart.

On the conveyance path 135, a color sensor 200 for detecting measurement images (hereinafter, referred to as patch images) on the sheet 110 is arranged. The color sensor 200 includes four sensors 200*a* to 200*d*, as shown in FIG. 3, aligned in the direction perpendicular to the conveyance direction of the sheet 110 to detect the patch images of four lines. In response to an instruction of color detection according to an instruction from an operation unit 180, the engine control unit 102 performs density adjustment, gradation adjustment, multinary color adjustment, and the like. In the density adjustment and the gradation adjustment, a density of a monochrome measurement image is measured, and in the multinary color adjustment, colors of a measurement image formed by superimposing a plurality of colors are measured.

The switching member 134 is a guiding member for guiding the sheet 110 to the external discharging path 139. The sheet 110 conveyed onto the discharging path 139 is discharged to the outside of the image forming apparatus 100.

Color Sensor

Figure 2:
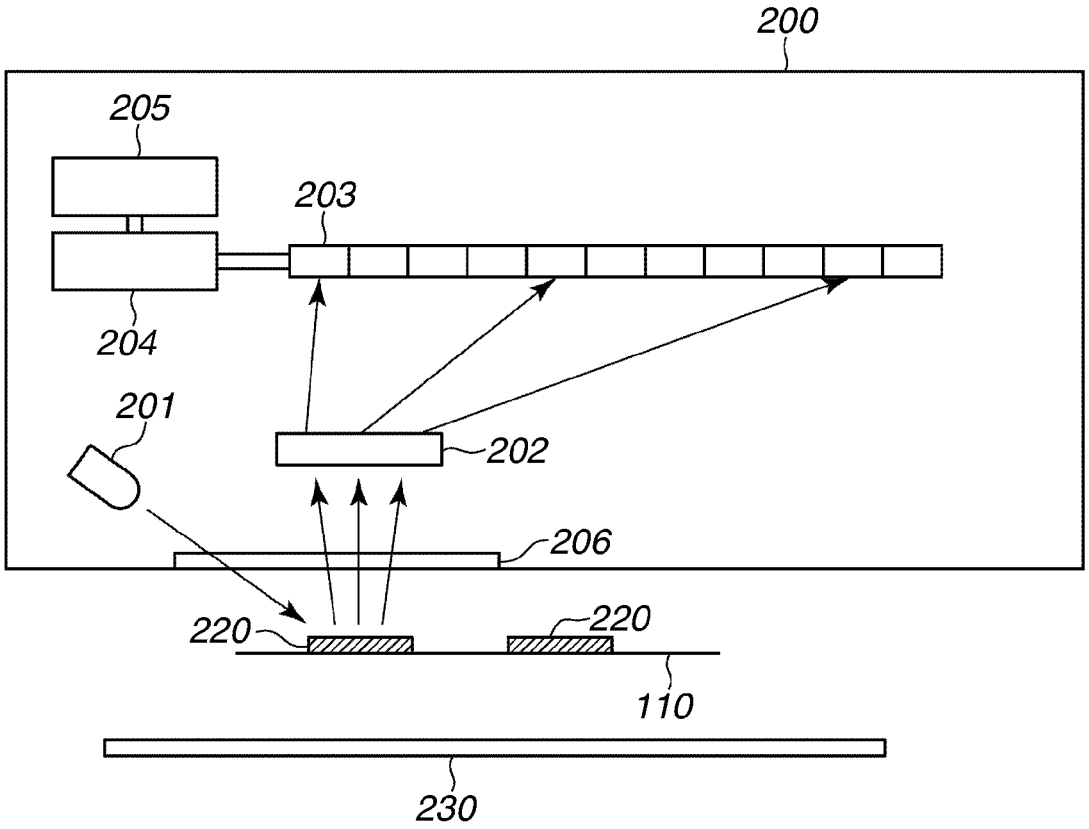
FIG. 2 illustrates a configuration of a color sensor 200.

FIG. 2 illustrates a configuration of the color sensor 200. In the color sensor 200, a white light-emitting diode (LED) 201, a diffraction grating 202, a line sensor 203, a calculation unit 204, and a memory 205 are provided. The white LED 201 is a light emitting element for emitting light to a patch image 220 on the sheet 110. The light reflected from the patch image 220 passes through a window 206 of a transparent member.

The diffraction grating 202 disperses the light reflected from the patch image 220 into wavelengths. The line sensor 203 serves as a light detection element including n pieces of light receiving elements for detecting the light dispersed into the wavelengths by the diffraction grating 202. The calculation unit 204 performs various calculations based on the light intensity values of the pixels detected by the line sensor 203.

The memory 205 stores various types of data to be used by the calculation unit 204. The calculation unit 204 includes, for example, a spectrum calculation unit for calculating a spectral reflectivity from a light intensity value. Further, a lens for collecting light emitted from the white LED 201 to the patch image 220 on the sheet 110, or for collecting reflected light from the patch image 220 to the diffraction grating 202 may be provided.

The white reference plate 230 is provided at a position opposed to the color sensor 200, and serves as a member to be read by the color sensor 200 in white correction. The white reference plate 230 having high lightfastness for reducing aging degradation and strength is desirably used. As a material for the white reference plate 230, for example, a material obtained by ceramic processing of aluminum oxide may be used.

The white reference plate 230 is detachably provided to the window 206 of the color sensor 200. In FIG. 2, for purposes of illustration, the white reference plate 230 is shown in a state (detachment state) located away from the window 206, however, in an actual measurement operation, the white reference plate 230 is to be set to a state (attachment state) located close to the window 206. In other words, in performing measurement of the white reference plate 230, the white reference plate 230 is set to the attachment state to measure the light reflected from the white reference plate 230. Based on the reflected light, a detection value of the color sensor 200 is corrected. Hereinafter, the correction processing with the white reference plate 230 is referred to as calibration.

Profile

In performing multinary color adjustment processing, the image forming apparatus 100 generates an International Color Consortium (ICC) profile, which will be described below, from a detection result of a patch image including a multinary color, and using the profile, converts an input image to form an output image.

The patch images 220 including a multinary color are varied in three levels (0%, 50%, and 100%) in dot area ratio with respect to respective four colors of CMYK. Then, patch images of all combinations of the dot area ratios of each color are formed. The patch images 220 formed by superimposing the plurality of colors are aligned, as illustrated in FIG. 3, in four lines to be read by the respectively color sensors 200*a* to 200*d*.

As the profile for implementing fine color reproducibility, in this exemplary embodiment, the ICC profile format prevalent in today's marketplace is used. Note that the exemplary embodiment of the present disclosure can be implemented by profiles other than the ICC profile format. For example, the exemplary embodiment of the present disclosure can use a Color Rendering Dictionary (CRD) employed since the Adobe's Level 2 PostScript introduced by Adobe Systems Inc., or a color separation table in Photoshop (registered trademark).

A user operates an operation unit 180 to instruct color profile generation processing when a customer engineer replaces components, before execution of a job involving a high color matching accuracy, or when the user wants to check tint of a final output product in a design planning stage.

Figure 4:
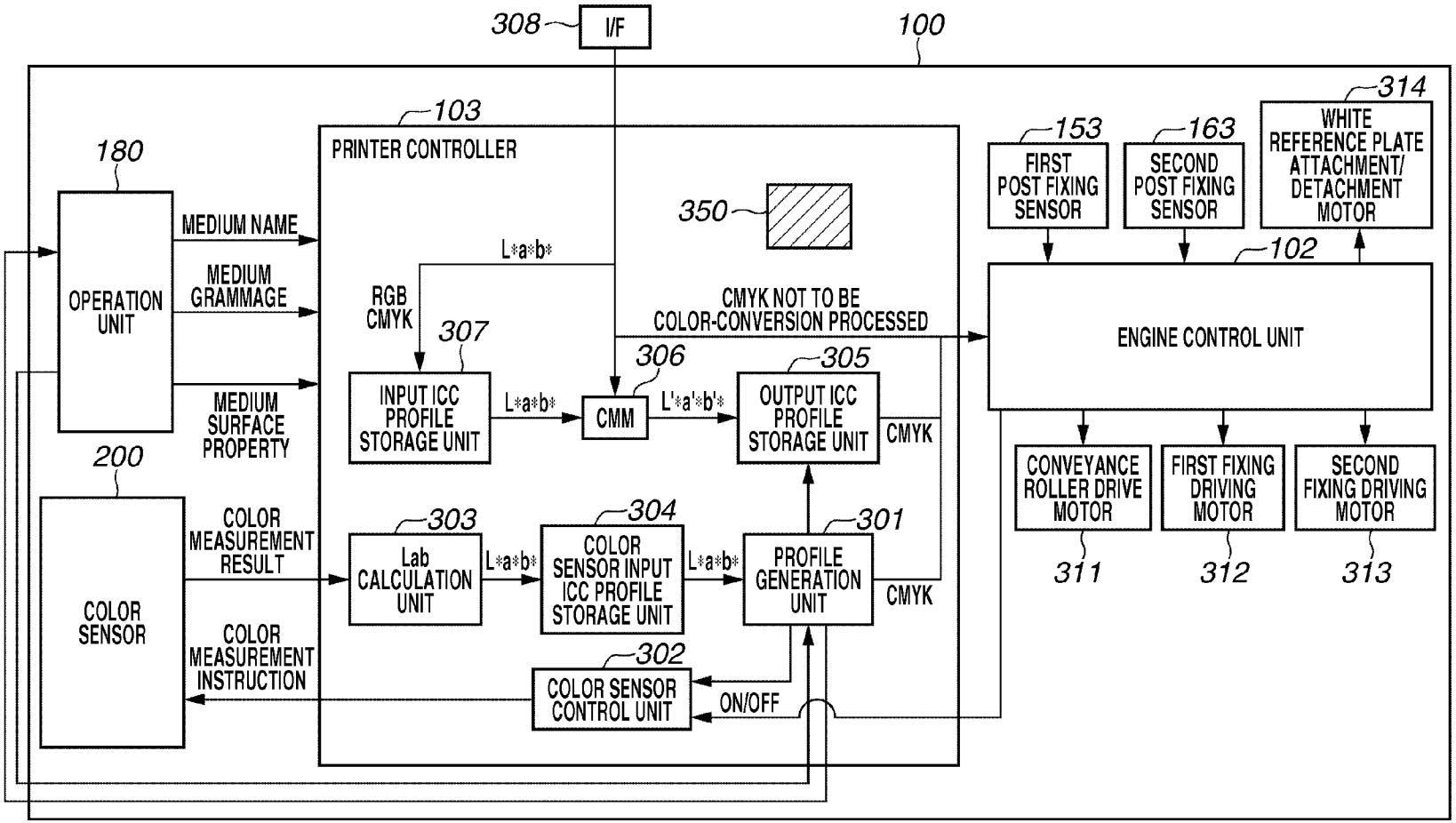
FIG. 4 is a block diagram illustrating a system configuration of the image forming apparatus 100.

The profile generation processing is performed in a printer controller 103 illustrated in the block diagram in FIG. 4. The printer controller 103 includes a central processing unit (CPU), and reads a program for implementing a flowchart, which will be described below, from a storage unit 350. In FIG. 4, to facilitate the understanding of the processing performed by the printer controller 103, inside of the printer controller 103 are illustrated by blocks.

In response to reception of a profile generation instruction in the operation unit 180, a profile generation unit 301 outputs a CMYK color chart 210 that is an ISO 12642 test form to an engine control unit 102 without involving a profile. The profile generation unit 301 sends a measurement instruction to a color sensor control unit 302. The engine control unit 102 controls the image forming apparatus 100 to perform processes such as charging, exposure, development, transfer, and fixing. By the processing, an ISO 12642 test form is generated on the sheet 110. The color sensor control unit 302 controls the color sensor 200 to measure the ISO 12642 test form. The color sensor 200 outputs spectral reflectivity data that is a measurement value to a Lab calculation unit 303 in the printer controller 103. The Lab calculation unit 303 converts the spectral reflectivity data into color value data (L*a*b* data), and outputs the data to the profile generation unit 301. The L*a*b* data output from the Lab calculation unit 303 is converted using a color sensor input ICC profile stored in a color sensor input ICC profile storage unit 304. The Lab calculation unit 303 may convert the spectral reflectivity data into the Commission Internationale de l'Éclairage (CIE) 1931 XYZ color space that is a device independent color space signal.

The profile generation unit 301 generates an output ICC profile based on a relationship between the CMYK color signal output to the engine control unit 102 and the L*a*b* data input from the Lab calculation unit 303. The profile generation unit 301 stores the generated output ICC profile into an output ICC profile storage unit 305.

The ISO 12642 test form includes a patch for a CMYK color signal covering a color reproducibility range that can be output by a general copying machine. Consequently, the profile generation unit 301 generates a color conversion table based on a relationship between each color signal value and a measured L*a*b* value. In other words, a conversion table for converting from CMYK to Lab is generated. Based on the conversion table, a reverse conversion table is generated.

The profile generation unit 301 receives a profile generation instruction from a host computer via an interface (I/F) 308, and outputs the generated output ICC profile via the I/F 308 to the host computer. The host computer can perform color conversion corresponding to the ICC profile using an application program.

A first fixing driving motor 312 is used to drive a first fixing unit 150. A second fixing driving motor 313 is used to drive a second fixing unit 160. These motors are controlled by the engine control unit 102. The engine control unit 102 also controls a white reference plate attachment/detachment motor 314 for attaching or detaching the white reference plate 230 to or from the window 206 of the color sensor 200.

Color Conversion Processing

In color conversion in normal color output, an RGB (red, green, blue) signal value input from a scanner unit via the I/F 308 or an image signal input expecting a standard print CMYK signal value such as Japan Color is sent to an input ICC profile storage unit 307 for external input. The input ICC profile storage unit 307, depending on the image signal input from the I/F 308, performs a conversion from RGB to L*a*b* or a conversion from CMYK to L*a*b*. The input ICC profile stored in the input ICC profile storage unit 307 includes a plurality of look-up tables (LUTs).

These LUTs are, for example, a one-dimensional LUT for controlling gamma correction of an input signal, a multinary color LUT called direct mapping, and a one-dimensional LUT for controlling gamma correction of generated conversion data. The input image signal is converted from a device-dependent color space into device-independent L*a*b* data using these LUTs.

The image signal converted into L*a*b* coordinates is input into a color management module (CMM) 306. The CMM 306 performs various kinds of color conversion. For example, the CMM 306 performs GAMUT conversion for mapping mismatch between a read color space of the scanner unit and the like serving as an input device, and an output color reproducibility range of the image forming apparatus 100 serving as an output device. The CMM 306 also performs color conversion for adjusting mismatch (also called mismatch in color temperature setting) between a light source type used in an inputting operation and a light source type used in an observation processing of an output product.

By the processing, the CMM 306 converts the L*a*b* data into L'*a'*b'* data, and outputs the L'*a'*b'* data to an output ICC profile storage unit 305. The profile generated as a result of the measurement has been stored in the output ICC profile storage unit 305. Accordingly, the output ICC profile storage unit 305 performs a color conversion based on the newly generated ICC profile to convert the L'*a'*b'* data into a CMYK signal that depends on an output device, and outputs the converted CMYK signal to the engine control unit 102.

Figure 5:
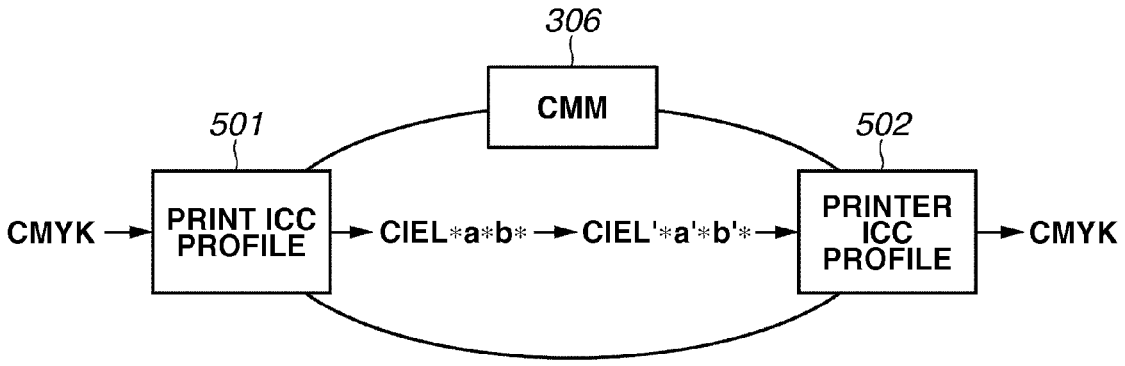
FIG. 5 illustrates a schematic view of a color management environment.

In FIG. 4, the CMM 306 is separated from the input ICC profile storage unit 307 and the output ICC profile storage unit 305. As illustrated in FIG. 5, however, the CMM 306 serves as a module that performs color management, and performs a color conversion using an input profile (print ICC profile 501) and an output profile (printer ICC profile 502).

In the above description, the basic operations of the measurement of spectral reflectivity by the color sensor 200, the color value calculation, the generation of the ICC profile, and the color conversion processing have been described. Hereinafter, processing for correcting a measurement error due to color change of the white reference plate 230 will be described.

Figure 6:
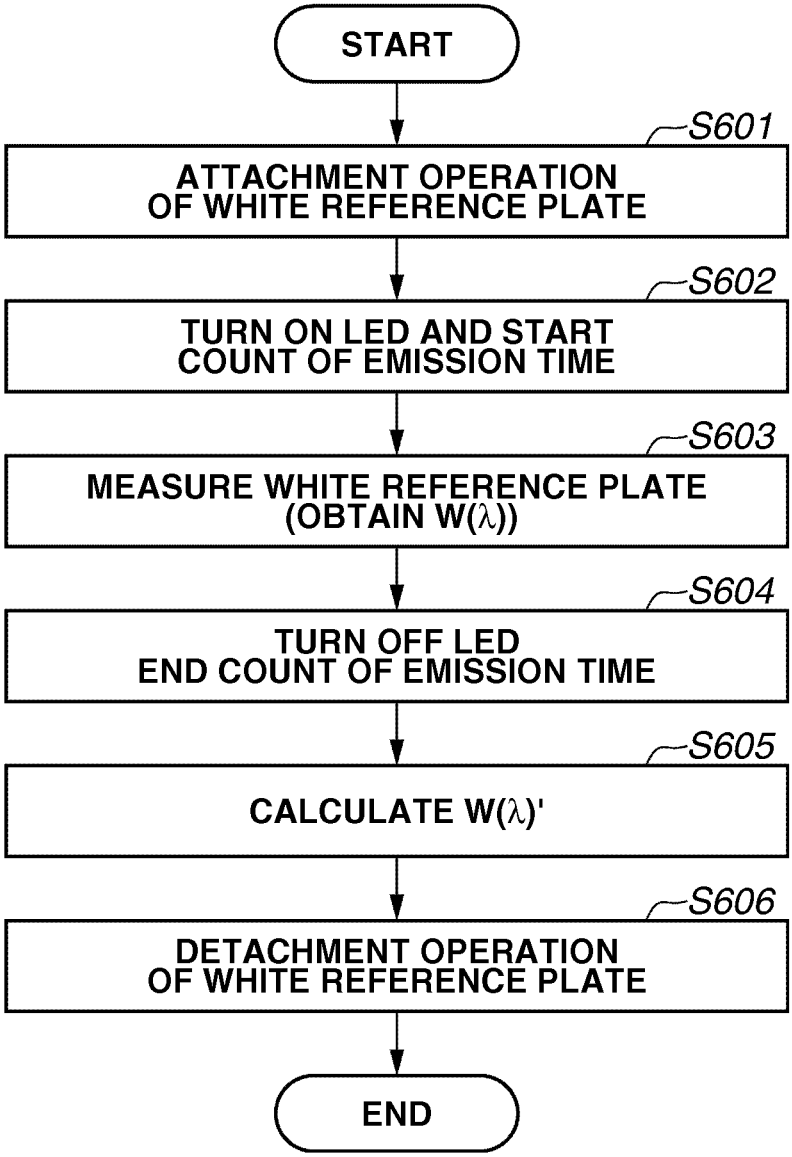
FIG. 6 is a flowchart illustrating a measurement operation of a white reference plate 230.

FIG. 6 is a flowchart illustrating a measurement operation of the white reference plate 230.

This flowchart is executed by the printer controller 103 at a timing before measurement of the patch image 220 is performed. The control of the image forming apparatus 100 is performed by the engine control unit 102 according to an instruction from the printer controller 103.

In step S601, the printer controller 103 drives the white reference plate attachment/detachment motor 314 to set the white reference plate 230 to attachment at the window 206 of the color sensor 200. Determining whether the attachment operation has been completed may include a method to wait for a period of time necessary for the operation, or a method to separately provide a sensor for detecting whether the plate has arrived at the attachment position, and either method may be employed.

In response to the completion of the attachment operation, in step S602, the printer controller 103 turns on a white LED 201 of the color sensor 200 while starting count of light emission time $t_0$. In step S603, the printer controller 103 measures, with the color sensor 200, a light amount in each wavelength range of the reflected light from the white reference plate 230. In this step, the measurement value is stored as W(λ) in the storage unit 350.

In response to the completion of the storage of W(λ) in the storage unit 350, in step S604, the printer controller 103 turns off the white LED 201 while ending the count of light emission time $t_0$. The printer controller 103 adds the light emission time $t_0$ to the cumulative emission time t, and stores the total cumulative emission time t in the storage unit 350.

In step S605, the printer controller 103, with respect to the measurement value W(λ) of the white reference plate 230, calculates W(λ)' in which a variation due to color change of the white reference plate 230 is to be corrected. In the calculation of W(λ)', the calculation method is to be changed depending on whether the amounts of reflected light from the white reference plate 230 linearly change with the passage of time, or non-linearly change with the passage of time. The calculation methods are described in detail below.

Figure 7:
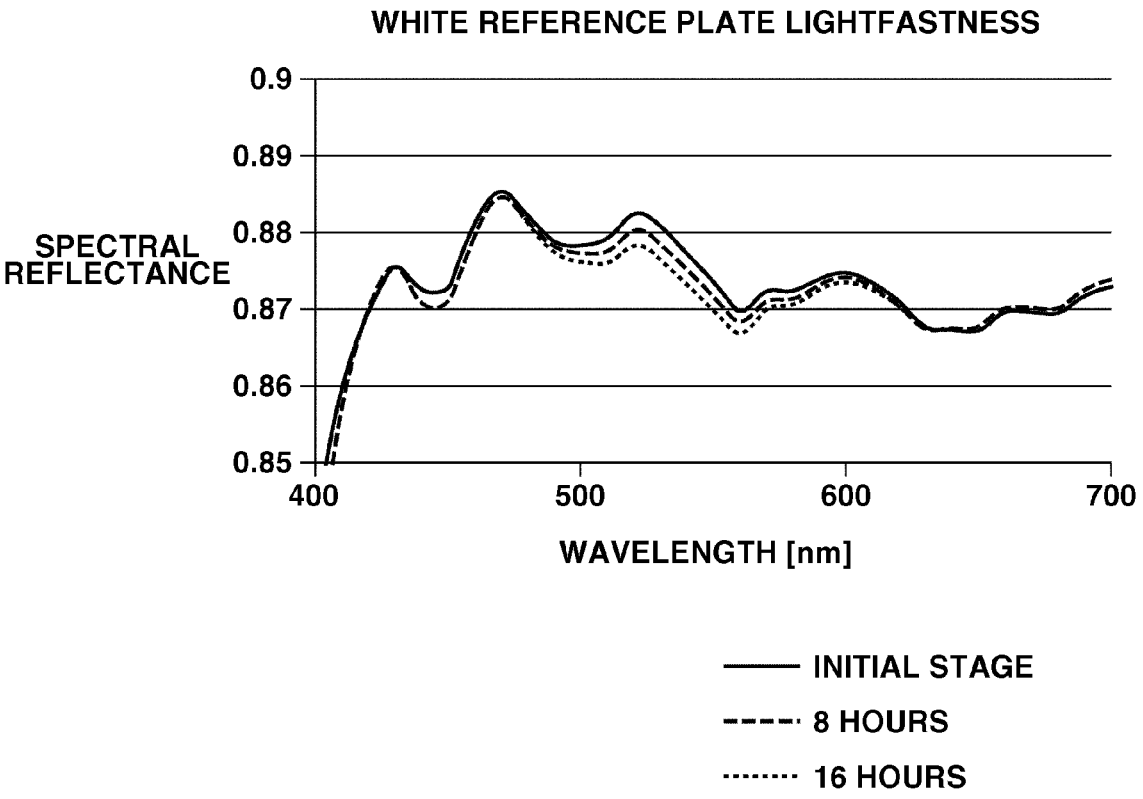
FIG. 7 illustrates variations in amounts of reflected light in emission of light toward the white reference plate 230 according to elapsed time.

FIG. 7 illustrates variation of amounts of reflected light in emission of light to the white reference plate 230 according to elapsed time. The solid line illustrates a waveform at an initial stage (cumulative emission time t=0), the dashed line illustrates a waveform at cumulative emission time t=8 hours, and the dotted line illustrates a waveform at cumulative emission time t=16 hours. As will be understood from the illustration, depending on the wavelength ranges, the variations in the amounts of the reflected light from the white reference plate 230 differ.

FIG. 8 illustrates an example of linear/non-linear variations in the amounts of the reflected light in each wavelength range. The unit of the wavelength in the chart is [nm]. As will be understood from the chart, depending on the wavelength ranges, the amounts of the reflected light from the white reference plate 230 differently vary linearly or non-linearly.

Figure 9A:
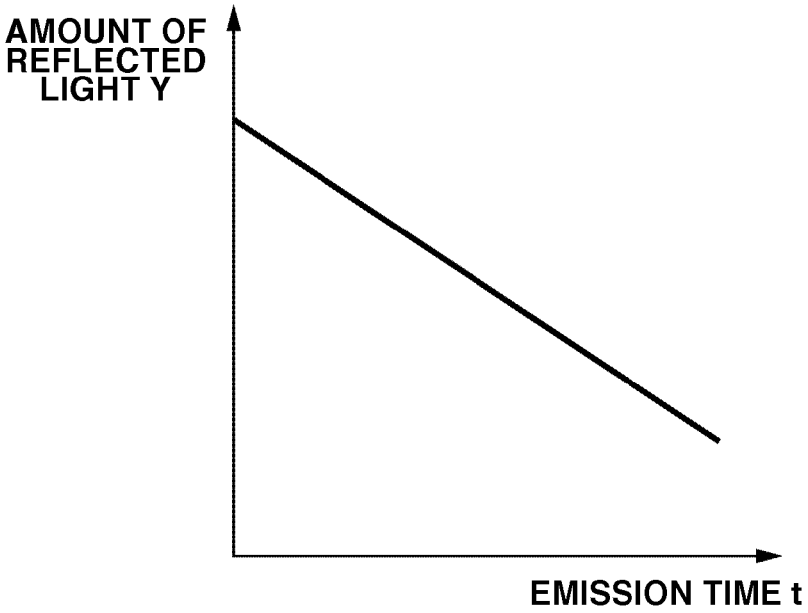
FIGS. 9A and 9B illustrate temporal change in the amounts of the reflected light from the white reference plate 230.

FIG. 9A illustrates variation in the amounts of the reflected light from the white reference plate 230 according to elapsed time in emission of a predetermined amount of light where the wavelength is λ1. In the case of the wavelength of λ1, a reflected light amount Y linearly varies with respect to emission time t. To the linearly varying wavelength range, the printer controller 103 reads a correction coefficient K(λ) stored in the storage unit 350 in advance, and calculates W(λ)' using the following (equation 2).

$$W(\lambda)'=W(\lambda)+KW(\lambda)\times t \qquad \text{(equation 2).}$$

The calculated W(λ)' is stored in the storage unit 350. The correction coefficient K(λ) is equal to the slope of the graph in FIG. 9A.

Figure 9B:
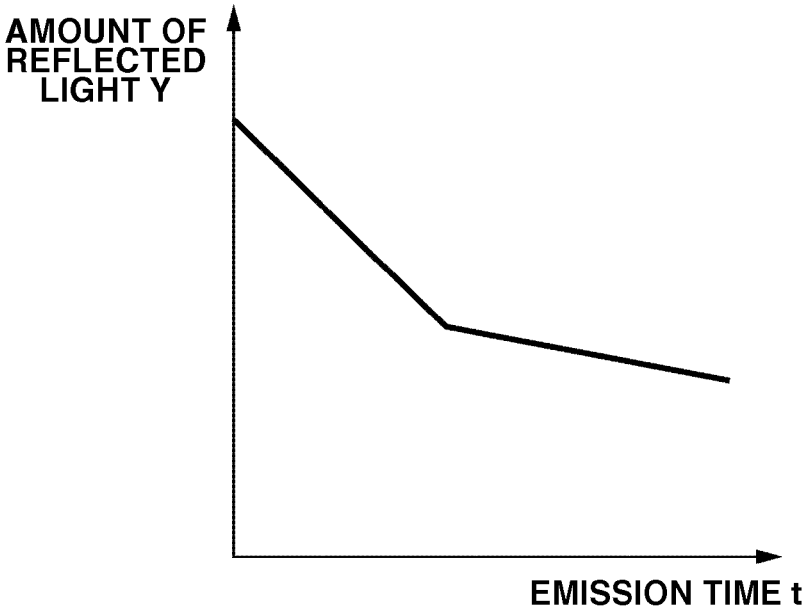

FIG. 9B illustrates variation in the amounts of the reflected light from the white reference plate 230 according to elapsed time in emission of a predetermined amount of light where the wavelength is λ2. In the case of the wavelength of λ2, a reflected light amount Y non-linearly varies with respect to emission time t. To the non-linearly varying wavelength range, the printer controller 103 refers to the correction table illustrated in FIG. 10 to read a correction coefficient L(t, λ) (t is an emission time period), and calculates W(λ)' using the following (equation 3).

$$W(\lambda)'=W(\lambda)\times L(t,\lambda) \qquad \text{(equation 3).}$$

After the calculation of the W(λ)', in step S606, the printer controller 103 drives the white reference plate attachment/detachment motor 314 to set the white reference plate 230 to detachment from the window 206 of the color sensor 200. In response to the completion of the detachment operation, the processing according to the flowchart ends.

Figure 11:
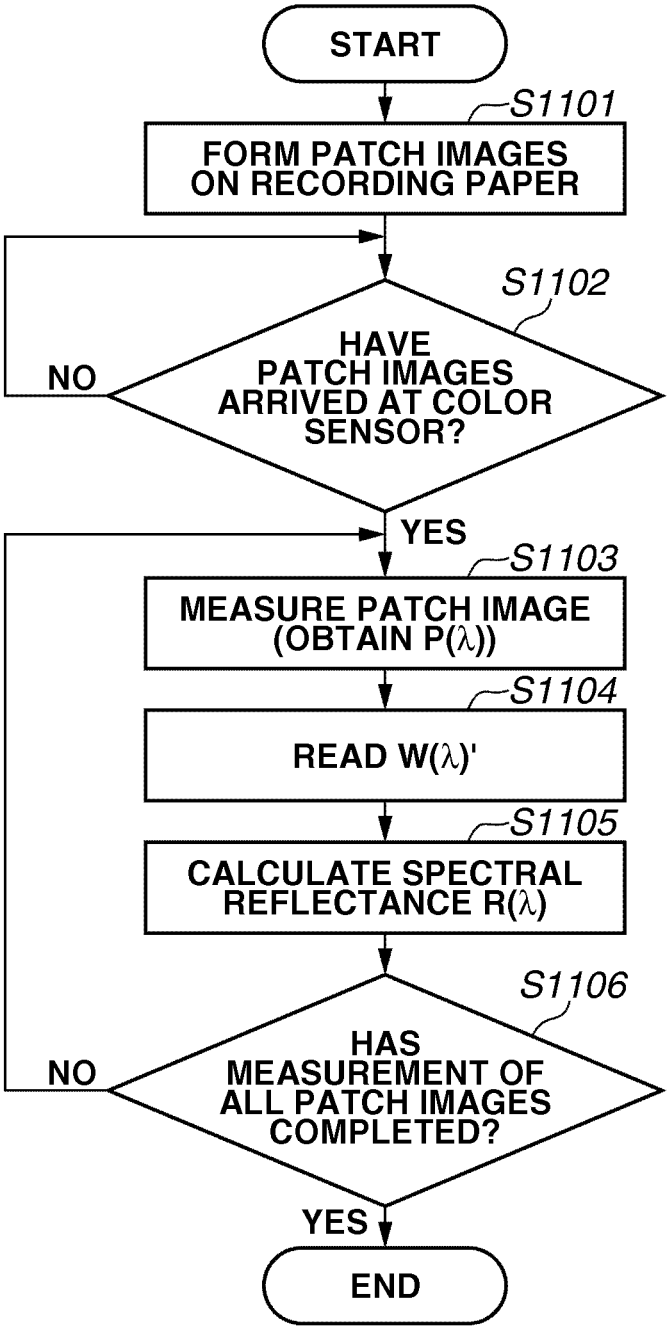
FIG. 11 is a flowchart illustrating a measurement operation of patch images 220.

FIG. 11 is a flowchart illustrating a measurement operation of the patch images 220.

This flowchart is executed by the printer controller 103. The control of the image forming apparatus 100 is performed by the engine control unit 102 according to an instruction from the printer controller 103.

This flowchart is executed when a user or an operator instructs to start patch image measurement by an operation on the operation unit 180. In step S1101, the printer controller 103 issues, to the engine control unit 102, an instruction to start formation of patch images 220 onto the sheet 110. In step S1102, the printer controller 103 waits until the sheet 110 (chart) on which the patch images 220 are formed arrives at the color sensor 220.

In step S1103, when the chart arrives at the color sensor 200, the printer controller 103 measures, with the color sensor 200, a light amount in each wavelength range of the reflected light from the patch image 220. In this step, the measurement value is stored as P(λ) in the storage unit 350. During the measurement of the patch images 220, the white reference plate 230 is detached (separated) from the color sensor 200.

In step S1104, the printer controller 103 reads the W(λ)' calculated in step S606 from the storage unit 350. In step S1105, the printer controller 103 calculates a spectral reflectivity R(λ) of the patch image 220 using the following (equation 4). In this calculation, by calculating a spectral reflectivity R(λ) using the W(λ)' instead of W(λ), the effect due to the color change of the white reference plate 230 can be corrected.

$$R(\lambda)=P(\lambda)/W(\lambda)' \qquad \text{(equation 4).}$$

In step S1106, the printer controller 103 determines whether the measurement of all patch images 220 has been completed. If the measurement has not been completed (NO in step S1106), the process returns to the above-described step S1103. On the other hand, if the measurement of all patch images 220 has been completed (YES in step S1106), the printer controller 103 ends the processing according to this flowchart.

Figure 12A:
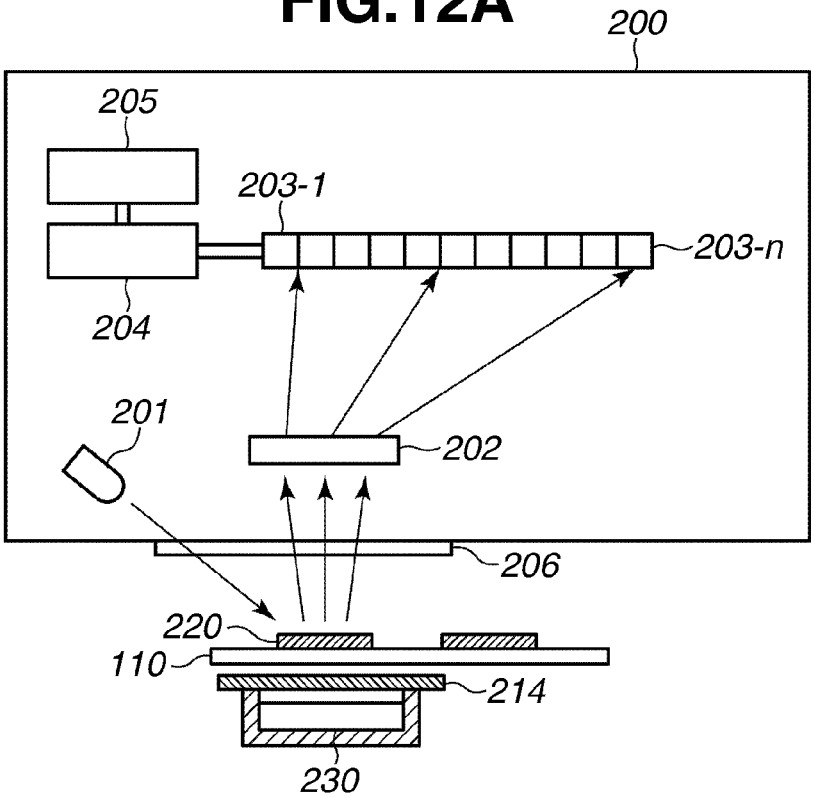
FIGS. 12A and 12B illustrate operation of a protection member 214 for covering the surface of the white reference plate 230.
Figure 12B:
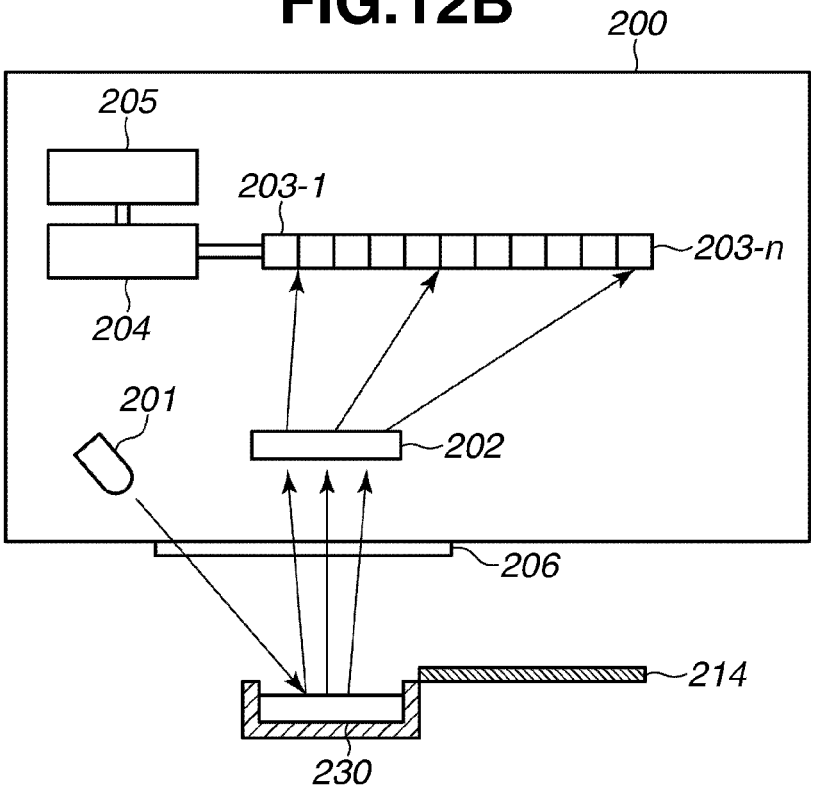

In this exemplary embodiment, a protective member 214 for reducing color change of the white reference plate 230 by shutting off the light may be provided. As illustrated in FIG. 12A, in the measurement of the patch image 220, the protective member 214 covers the surface of the white reference plate 230. Meanwhile, as illustrated in FIG. 12B, in a case where the color sensor 200 receives the reflected light from the white reference plate 230, the protective member 214 moves to expose the surface of the white reference plate 230. By providing the protective member 214, in addition to the reduction of the color change of the white reference plate 230, adhesion of a foreign object to the white reference plate 230 can also be reduced.

As described above, in the exemplary embodiment, depending on color change of the white reference plate 230, W(λ) is corrected to calculate W(λ)', and a spectral reflectivity R(λ) is calculated using the W(λ)'. The variation of measurement values due to color change differs in each wavelength region of the reflected light. Consequently, by calculating the W(λ)' for each wavelength region of a measurement target, the correction corresponding to the color change of the white reference plate 230 can be performed.

By the operation, the measurement accuracy of the patch images 220 can be maintained even if the white reference plate 230 changes color due to continual light emission. Further, cost increases due to replacement of the color changed white reference plate 230 can be prevented and occurrence of downtime due to the replacement can be prevented.

In this exemplary embodiment, in the calculation procedure, a measurement value W(λ) of the reflected light from the white reference plate 230 is multiplied by a correction coefficient. Alternatively, a measurement value P(λ) of the reflected light from the patch image 220 or a spectral reflectivity R(λ) of the patch image 220 can be multiplied by a correction coefficient.

Further, in this exemplary embodiment, the calculation methods are changed depending on whether the amounts of reflected light from the white reference plate 230 linearly vary or non-linearly vary according to elapsed time. Alternatively, irrespective of linear or non-linear variation, the entire wavelength range can be corrected using one correction table. In such a case, the amount of data of the correction table is large, however, it is not necessary to perform the linear/non-linear determination for each wavelength region, and this prevents complicated calculation processing.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims priority from Japanese Patent Application No. 2012-215698, filed Sep. 28, 2012, which is hereby incorporated by reference herein in its entirety.

What is claimed is:

1. An image forming apparatus comprising:

a measurement unit configured to emit light to a measurement target, and measure reflected light from the measurement target;

a white reference plate disposed at a position opposed to the measurement unit;

an image forming unit configured to form a measurement image on a sheet; and a calculation unit configured to, based on a measurement value of the white reference plate and a measurement value of the measurement image by the measurement unit, calculate a spectral reflectivity of reflected light from the measurement image, wherein the calculation unit is configured to, after correcting a variation due to color change of the white reference plate with respect to the measurement value of the white reference plate, calculate the spectral reflectivity.

2. The image forming apparatus according to claim 1, further comprising a time measuring unit configured to count cumulative emission time of the light emitted to the white reference plate, wherein the calculation unit, based on a counted value of the time measuring unit, corrects the variation due to color change of the white reference plate with respect to the measurement value of the white reference plate.

3. The image forming apparatus according to claim 2, wherein a correction coefficient for correcting the variation due to the color change of the white reference plate differs depending on wavelengths of reflected light from the white reference plate and the counted value of the time measuring unit.

4. The image forming apparatus according to claim 2, wherein the calculation unit changes correction of the variation due to the color change of the white reference plate depending on a wavelength range of linearly varying reflected light and a wavelength range of non-linearly varying reflected light from the white reference plate.

5. The image forming apparatus according to claim 4, wherein the calculation unit is configured to, in the linearly varying wavelength range, correct the measurement value of the white reference plate by multiplying the measurement value of the white reference plate by a coefficient corresponding to the counted value of the time measuring unit, and in the non-linearly varying wavelength range, correct the measurement value of the white reference plate, based on the counted value of the time measuring unit, by referring to a preset correction table.

6. The image forming apparatus according to claim 1, further comprising an attachment/detachment unit configured to attach or detach the white reference plate to or from the measurement unit, wherein the attachment/detachment unit is configured to, in measurement of the white reference plate by the measurement unit, perform an attachment operation to locate the white reference plate close to the measurement unit, and in measurement of the measurement image by the measurement unit, perform a detachment operation to locate the white reference plate away from the measurement unit.

7. The image forming apparatus according to claim 1, further comprising a protection member configured to, if the white reference plate is not being measured by the measurement unit, shut off the light by covering a surface of the white reference plate.

8. The image forming apparatus according to claim 1, wherein the image forming unit forms the measurement image by superimposing a plurality of color materials on the sheet, and wherein the measurement unit measures a light amount in each wavelength of reflected light from the measurement image formed by superimposing the plurality of the color materials.

9. The image forming apparatus according to claim 1, wherein the calculation unit corrects a measurement result of the measurement image by the measurement unit based on a measurement result of the white reference plate to calculate the spectral reflectivity of the reflected light from the measurement image.

10. The image forming apparatus according to claim 9, further comprising a second calculation unit configured to calculate a color value from the spectral reflectivity.

11. The image forming apparatus according to claim 10, wherein based on a calculation result of the second calculation unit, a color correction table is generated.

12. The image forming apparatus according to claim 11, wherein the color correction table is an ICC (International Color Consortium) profile.

13. The image forming apparatus according to claim 1, wherein the image formation unit forms a monochrome measurement image at a time of density measurement, and forms a multicolor-superimposed measurement image at a time of color measurement.

14. The image forming apparatus according to claim 1, further comprising a first conversion unit configured to convert RGB (red, green, blue) data and CMYK (cyan, magenta, yellow, black) data input from the outside, into L*a*b* data.

15. The image forming apparatus according to claim 1, further comprising a second conversion unit configured to convert L*a*b* data into CMYK (cyan, magenta, yellow, black) data, wherein the image forming unit performs an image forming operation onto the sheet based on the CMYK data.

16. The image forming apparatus according to claim 1, further comprising a fixing unit configured to fix the measurement image formed by the image forming unit on the sheet, wherein the measurement unit is provided on the downstream side of the fixing unit in a sheet conveyance direction.

17. The image forming apparatus according to claim 1, wherein the measurement unit is provided, to form an image on a back surface of the sheet, in a conveyance path in which the sheet having the images formed on the front surface passes.

18. The image forming apparatus according to claim 1, wherein the sheet that has passed through the measurement unit reverses traveling direction to pass through the measurement unit again.

19. The image forming apparatus according to claim 1, wherein the image forming unit transfers a toner onto the sheet to form the measurement image.

20. The image forming apparatus according to claim 1, wherein the image forming unit discharges ink to form the measurement image on the sheet.

* * * * *